US009758230B2

(12) United States Patent
Elvestad et al.

(10) Patent No.: US 9,758,230 B2
(45) Date of Patent: Sep. 12, 2017

(54) RUDDER

(71) Applicant: ROLLS-ROYCE MARINE AS RUDDERS, Ålesund (NO)

(72) Inventors: Stig Elvestad, Saebo (NO); Ashley Bryant, Derby (GB); Adil Saleem, Alesund (NO); Marte Ellingsen, Alesund (NO); Peter Gielesen, Ulsteinvik (NO); Maciej Roga, Rzeszow (PL); Lars Rune Bolstad, Fiskarstrand (NO)

( * ) Notice: Subject to any disclaimer, the term of this patent is extended or adjusted under 35 U.S.C. 154(b) by 0 days.

(21) Appl. No.: 14/773,463

(22) PCT Filed: Mar. 7, 2014

(86) PCT No.: PCT/NO2014/050029
§ 371 (c)(1),
(2) Date: Sep. 8, 2015

(87) PCT Pub. No.: WO2014/137222
PCT Pub. Date: Sep. 12, 2014

(65) Prior Publication Data

US 2016/0176493 A1 Jun. 23, 2016

(30) Foreign Application Priority Data

Mar. 8, 2013 (NO) ..... 20130356
Jul. 15, 2013 (NO) ..... 20130981

(51) Int. Cl.
*B63H 25/06* (2006.01)
*B63H 25/42* (2006.01)
*B63H 25/38* (2006.01)

(52) U.S. Cl.
CPC ..... *B63H 25/38* (2013.01); *B63H 25/381* (2013.01); *B63H 2025/066* (2013.01); *B63H 2025/388* (2013.01)

(58) Field of Classification Search
CPC B63H 25/38; B63H 25/381; B63H 2025/066; B63H 2025/388
(Continued)

(56) References Cited

U.S. PATENT DOCUMENTS 3,606,852 A 9/1971 Cafiero
4,284,025 A 8/1981 Eckhard
(Continued)

FOREIGN PATENT DOCUMENTS

DE 19746853 A1 4/1999
EP 0170919 B1 2/1986
(Continued)

OTHER PUBLICATIONS

Written Opinion for PCT/NO2014/050029 mailed Jul. 7, 2014.
(Continued)

*Primary Examiner* — Anthony Wiest
(74) *Attorney, Agent, or Firm* — Ben Schroeder Law PLLC

(57) ABSTRACT

A rudder for as ship is described, comprising a rudder blade (10) which is fastened via a rudder stock (32) to the aft end (16) of the ship, where the rudder blade (10) is a rudder blade of the suspension type, comprising a first rudder blade part (12) and a second rudder blade part (14), arranged above and below each other, respectively, the rudder stock (32) is mounted and fastened to the rudder blade (10) and extends up into the aft end (16) of the ship, where the rudder stock is coupled at the upper end to a steering gear (20) arranged at the aft end (16) of the ship. An outer tube (34) is arranged about the rudder stock (32) where the outer tube (34) is fastened in the first, upper rudder blade part (12) and the aft end (16) of the ship, respectively, and that the rudder stock (32) extends through the outer tube (34) and down into the second, lower rudder blade part (14).

16 Claims, 3 Drawing Sheets

(58) Field of Classification Search
USPC ..... 114/162, 165, 167, 169
See application file for complete search history.

(56) References Cited

U.S. PATENT DOCUMENTS

| | | | |
|---|---|---|---|
| 4,342,275 | A | 8/1982 | Brix et al. |
| 2007/0000423 | A1 | 1/2007 | Lehmann |
| 2008/0314303 | A1 | 12/2008 | Kluge |
| 2009/0126614 | A1 | 5/2009 | Kluge |
| 2010/0037809 | A1 | 2/2010 | Lehmann |

FOREIGN PATENT DOCUMENTS

| | | | |
|---|---|---|---|
| EP | 2060485 | B1 | 5/2009 |
| EP | 2163472 | A1 | 3/2010 |
| GB | 518853 | A | 3/1940 |
| JP | H0539089 | A | 2/1993 |

OTHER PUBLICATIONS

International Preliminary Report on Patentability of PCT/NO2014/050029 mailed Jul. 30, 2015.
International Search Report for PCT/NO2014/050029 mailed Jul. 7, 2014.

RUDDER

This application claims priority under 35 USC §§365 and 371 to PCT/NO2014/050029, filed Mar. 7, 2014, which in turn claims priority to NO 20130356, filed Mar. 8, 2013 and NO 20130981, filed Jul. 15, 2013, all of which are incorporated by reference in their entireties.

The present invention relates to a rudder for a ship, comprising a rudder blade which is fastened to the aft end of the ship via a rudder stock. The rudder blade is of the suspension type, comprising a first rudder blade part and a second rudder blade part arranged above and below each other, respectively, and where the rudder stock is mounted in, and fastened to, the rudder blade and extends up in the aft end of the ship where the rudder stock is connected, at its upper end, to a steering gear placed at the aft end.

The invention concerns the shaping, fastening and mounting of a rudder in the form of, for example, twisted rudder blades to the aft end of a ship. The invention also relates to the forming of a rudder blade fastened to the aft end of a ship and which is equipped with flaps.

From prior art reference is made, among others, to EP2060485B1, Becker Marine Systems GmbH & Co. This document presents a rudder device in the form of a twisted, balanced rudder with a propeller and which is connected to the aft end of a ship with a rudder stock. The rudder blade has two profile parts twisted in relation to each other, where the upper part is the highest. The upper part has a gently arched shape on the one side at the front and in the widest area, with a more pronounced arched shape at the other side, and where the sides behind the widest area run straight together to an end point. The lower part is correspondingly shaped. The two profile parts are symmetrical at the rear part of the rudder blade. The forward part of each profile part is equipped with its own front edge strip with an approximate semi-circular profile and the end of the rudder blade is equipped with an end strip. The rear part of each profile has a length which is at least 1.5 times the length of the forward part. The straight part of each profile runs from one point at a distance behind the widest area which is given to be at least ⅓ of the length of the distance between the widest area and the front edge of the profile. Furthermore, it appears that guiding plates (cover plates) are arranged, that cover the supplementing area between the two twisted profile parts, and where the guiding plates extend from the front and back on the side surfaces on each profile. The rudder stock is mounted at the widest area or at the forward part of the rudder blade. Furthermore, the rudder stock is mounted in the upper profile part only and extends above this. The rudder stock is mounted in a tube (handle opening tube) that is fastened to the upper profile part and which is equipped with a bearing. One part of the rudder stock sticks out of the tube and is fastened to the upper profile part.

From EP2060486B1, also belonging to Becker Marine Systems GmbH & Co, a similar rudder device can be seen. A twisted balanced rudder with a propeller is described which is connected to the aft end of a ship with a rudder stock. The rudder blade has two twisted profile parts with respect to each other, where the upper part is the highest. The upper part has a gently arched form on the one side at the front and the widest area and has a much more pronounced arched form on the other side where the sides behind the widest area run straight together into an end point. The lower part is formed correspondingly. The two profile parts are symmetrical at the rear part of the rudder blade. The forward part of each profile part is fitted with its own front edge strip with an approximately semi-circular formed profile and the end of the rudder blade is fitted with an end strip. The rear part of each profile has a length that is at least 1.5 times the length of the front part. The straight part of each profile runs from a point at a distance behind the widest area which is given to be at least ⅓ of the length of the distance between the widest area and the front edge of the profile. Furthermore, it is indicated that the rudder stock is fitted in the widest area or in the forward part of the rudder blade. Furthermore, the rudder stock is mounted in the upper profile part only and extends above this so that the lower profile shows a narrow profile.

Furthermore, reference is made to KR 20070003539 A, KR 20080061126 A, US 2007/000423 A1 and US 2009/0126614 A1 which relate to fastening devices for the rudder stock in the rudder blade, where the rudder stock extends far into the rudder blade and is fastened with a bolt connection and here the rudder stock is mounted in an upper and lower bearing in the rudder blade. From KR 20080061126 A in particular, an upper and lower bearing are known where both bearings are placed in an upper and lower part of an overlapping area between the rudder blade and the rudder box.

From GB 518853 A a hollow rudder stock is shown in the form of an open or closed tube that extends from the hull (rudder box) and into the rudder blade. The rudder box is fitted with bearings and seals for the tube, and the rudder blade is fitted with a bearing for the uptake and fastening of the tube, where the bearing is placed approximately in the middle of the rudder blade.

In addition, reference is also made to US 2010/0037809 A1, NO 147408 B and WO 2005/113332 A1.

With the present invention one aims to provide a solution which, to a considerable extent, reduces or removes completely radial loads on the steering gear of the rudder and which considerably reduces radial loads on the bearing of the rudder. The new rudder solution will also be able to reduce the weight of the whole rudder system.

Other advantages are that transport and maintenance can be simplified. It can be possible to remove, among other things, the propeller shaft without disconnection of the steering gear. Transport of large rudder blades in two parts, for example, is also made possible.

It can also be possible to achieve considerable cost reductions. Because of the design of the system it will be possible to reduce the costs due to the reduction of the radial loads, and it will also be possible to simplify the manufacturing process.

Therefore, it is an object to provide a rudder solution that can provide the above mentioned advantages.

The use of flaps on the rudder blade allows the geometry of the foil (the profile of the rudder blade) to be changed. The main advantages of this is that a greater lift from the flow of the water can be generated over the foil due to the higher stall angle and that a lower drag can be maintained at a small rudder angle.

Flaps on rudders are, in the main, used on ships that have a need for good manoeuvring.

The advantage of using divided flaps is basically to permit deflection of the rudder without this transmitting large forces onto the mounting and the structure of the flap, but it also opens for individual control of the upper vs. the lower part, which one can imagine used to contribute to the control of the stability of the ship. Divided flaps will also ease the production and fitting of the rudder blade and also the transport of the parts.

It can also be an advantage that the joining together of the flaps parts is designed so that it fails for other mechanisms, so that, for example, the upper flaps will still be operating after a break between the parts, for example, after a collision with a foreign body/running aground, etc.

Furthermore it would be an advantage to have control of individual flaps. This is a premise to achieve the stability control mentioned above, but it is also possible to imagine that this can open for a more "propulsion effective" course correction during transit (steaming) where the rudder can be kept at 0 degrees and the flaps can alter the angle to generate the necessary lift (side force) for the course correction.

In addition, with the present invention one aims to provide a solution using flaps that satisfies one or more of the above mentioned advantages.

According to one aspect of the invention, a rudder for a ship is provided, comprising a rudder blade which is fastened via a rudder stock, to the aft end of the ship, where the rudder blade is a twisted rudder blade of the suspension type, comprising a first rudder blade part and a second rudder blade part, arranged above and below each other, respectively, where said rudder blade parts further comprise a first rudder blade profile and a second rudder blade profile that are twisted in relation to each other, and the rudder stock is mounted and fastened in the rudder blade and extends up into the aft end of the ship, where the rudder stock is connected at an upper end to a steering gear arranged in the aft end. The rudder is characterised in that an outer tube is arranged about the rudder stock, where the outer tube is fastened in the first and upper rudder blade part and in the aft end of the ship, respectively, and that the rudder stock extends through the outer tube and down into the second and lower rudder blade part.

Alternative embodiments are given in the dependent claims.

A sleeve coupling can be arranged in an upper part of the lower rudder blade and a lower part of the rudder stock can be mounted in the sleeve coupling. Furthermore, the sleeve coupling can be connected to the upper rudder blade part.

The outer tube can extend through the whole, or most of, the upper rudder blade part. Furthermore, at least one bearing can be arranged around the outer tube in the upper rudder blade part. A lower radial bearing can be arranged about the outer tube in the upper rudder blade part and an upper radial bearing can be arranged about the outer tube and to the aft end of the hull.

The two rudder blade parts can be connected together in a bolt connection that lies in an area above a central axis that corresponds with the shaft of the propeller.

The rudder blade is preferably a twisted rudder blade of the suspension type, comprising the first rudder blade part and the second rudder blade part arranged above and below each other, respectively, where said rudder blade parts further comprise a first rudder blade profile and a second rudder blade profile that are twisted in relation to each other. Said central axis preferably constitutes a divider between the two corresponding twisted rudder blade profiles.

Furthermore, the lower rudder blade part comprises the whole of the lower rudder blade profile, and also parts of the upper rudder blade profile and the upper rudder blade part can comprise the rest of the upper rudder blade profile.

As mentioned, the two rudder blade profiles can be formed to be correspondingly alike and are preferably formed with an approximately parabolic shaped nose section which, on one side, runs in an gently arched shape towards and beyond the largest profile thickness of the rudder blades and on the other side runs in a more pronounced arched shape towards and beyond the largest profile thickness of the rudder blade and that from an area where said arched shapes end, the rudder blade profiles run symmetrically towards a rear edge of the rudder blade in a concave form.

A rudder as described above is also provided, where the rear edge of the rudder blade is equipped with vertically arranged flaps, where the flaps comprise an upper and a lower part, arranged above and below each other, respectively.

The upper and the lower part of the flaps are preferably arranged in respective upper and lower hinges, where the upper hinge of the upper part of the flaps is placed in an upper part of the rudder blade and the lower hinge of the upper part of the flaps is placed in an area above the central axis that corresponds to the shaft of the propeller, and the upper hinge of the lower part of the flaps is placed adjoining or in the central axis that corresponds with the shaft of the propeller and the lower hinge of the lower part of the flaps is placed in a lower part of the rudder blade.

Furthermore, the lower part of the flaps can be rotary mounted in a lower hinge in the lower rudder blade part and in an upper hinge in the lower rudder blade part, where the upper hinge is placed in, or adjoining, the central axis that corresponds with the shaft of the propeller. The upper part of the flaps can be rotary mounted in a lower hinge in the upper rudder blade part where the lower hinge is placed adjoining an area where the two rudder blades are connected and in an upper hinge in the upper rudder blade part.

It is preferred that the lower part of the flaps extends from an area adjoining the lower hinge in the lower rudder blade part to an area adjoining the lower hinge in the upper rudder blade part and the upper part of the flaps can extend from an area adjoining the lower hinge to an area adjoining the upper hinge in the upper rudder blade part.

The lower part of the flaps is preferably rotary mounted on a fastening shaft arranged between the lower hinge and the upper hinge in the lower rudder blade part. The upper part of the flaps is preferably rotary mounted on a fastening shaft arranged between the lower hinge and the upper hinge in the upper rudder blade part.

The fastening shaft for the upper part of the flaps can extend into a further hinge placed in the upper part of the lower rudder blade part.

The upper part and the lower part of the flaps can be connected via a coupling piece, where the coupling piece is set up to function as a shear pin.

Furthermore, the rudder blade can comprise a steering device connected to a fastening shaft of the upper part of the flaps and/or to a fastening shaft of the lower part of the flaps where the steering device comprises at least one arm coupled to a steering rod and where the steering rod is connected to the steering gear and that the steering device is set up for combined or individual rotation of the upper part and the lower part of the flaps.

The invention shall now be explained in more detail with the help of the enclosed figures, in which.

Figure 1:
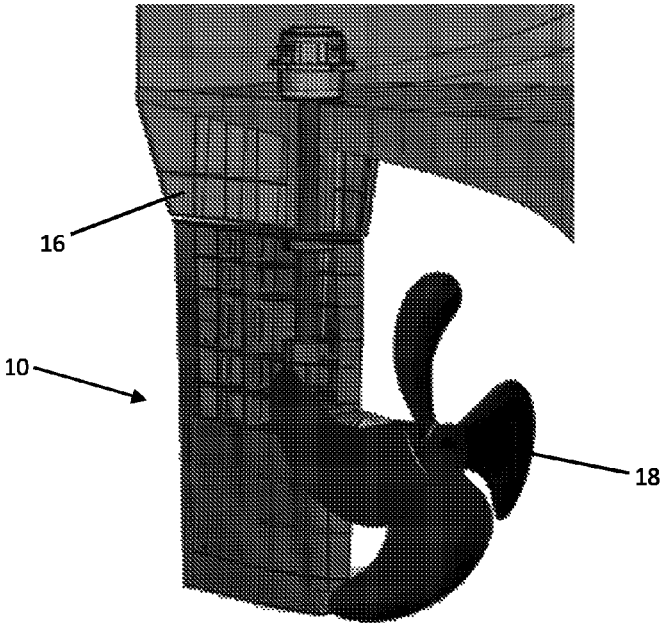
FIG. 1 shows a diagram of a rudder blade, rudder stock and steering gear according to the invention, fastened to the aft end of a ship and adjoining a propeller.
Figure 2:
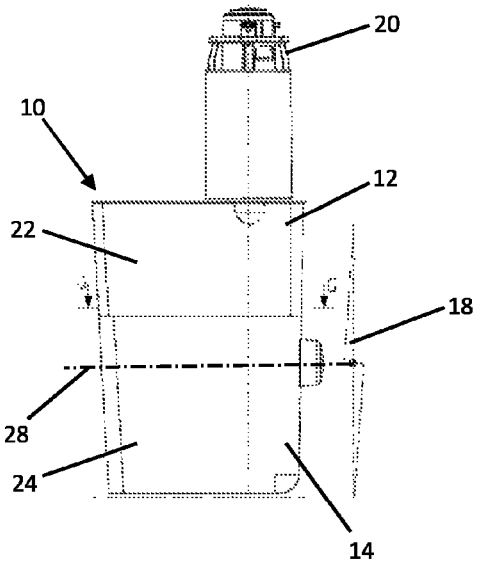
FIGS. 2 and 3 show an outline and a profile drawing, respectively, of the rudder blade, rudder stock and steering gear.
Figure 3:
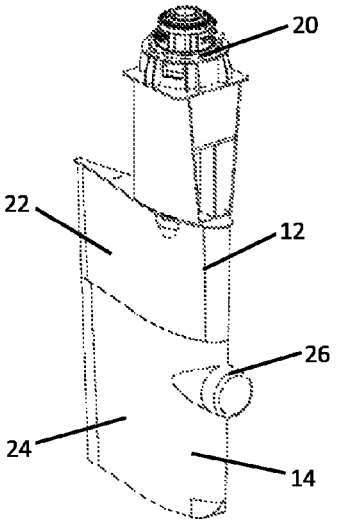

As the figures show the present invention relates to a rudder blade 10 that is fastened to the aft end 16 of a ship (the rest of the ship is not shown in any detail) and with a propeller 18 that is placed in front of the rudder blade 10.

Twisted Rudder Blade

The rudder, in the form of a rudder blade 10, is basically of the complete suspension type and comprises, in a known way, two rudder blade parts 12,14 which form the rudder blade when put together. Furthermore, the rudder blade can comprise two rudder blade profiles 22,24 that are twisted in relation to each other. The two rudder blade profiles 22,24 are basically formed correspondingly alike and are preferably formed with an approximate parabolic formed nose section 46 which runs, on one side, in a gently arched shape towards and beyond the greatest profile thickness of the rotor blade 10 and, on the other side, runs in a more pronounced arched shape towards and beyond the greatest profile thickness of the rudder blade 10. From an area where said arched shapes end, the rudder blade profiles 22,24 run symmetrically towards a rear edge 44 of the rudder blade (10) with a preferably concave form.

Contrary to known techniques the two rudder blade parts 12,14 according to the invention are coupled together in a bolt connection 30, or alternatively in another form of coupling, that lies in an area above a central axis 28 that corresponds with the shaft of the propeller 18. In addition, to connect the two rudder blade parts 12,14 the bolt connection 30 also has the task of transferring the bending forces and weight from the lower rudder blade part 14 to the upper rudder blade part 12. In the coupling between the two rudder blade parts 12,14, i.e. in the bolt connection 40, a number of tube pins can be used to contribute to the transfer of loads from the shear forces from the lower rudder blade 14 to the upper rudder blade 12.

Said central axis 28 makes up, in a known way, the divide between the two correspondingly twisted rudder blade profiles 22,24, but the lower rudder blade part 14 comprises, according to the invention, the whole of the lower rudder blade profile 24 and also parts of the upper rudder blade profile 22, and the upper rudder blade part 12 comprises the rest of the upper rudder blade profile 22.

A very general appraisal indicates that the upper rudder blade profile 22 can extend, for example, to 15-25% of the total height of the rudder down in the lower rudder blade part 14. However, there can be great variations and it can be considered that the upper rudder blade profile 22 extends from 0% to 40% of the total height of the rudder down in the lower rudder blade part 14. The size will vary from ship to ship based on variables such as propeller diameter, propeller shaft diameter, speed of the ship, etc., and also vary for different rudder types, such as if the rudder is with or without flaps, etc.

Thus, that the upper rudder blade profile 22 is higher and represents a larger surface than the lower rudder blade profile 24, while the upper rudder blade part 12 is preferably shorter and represents a smaller surface than the lower rudder blade part 14. This will, among other things, ease the replacing of the propeller and the propeller shaft.

A coat 26, bulb, or the like can be arranged in the nose section 46 in front of the rudder blade 10, where the coat is placed centrally about the central axis 28 and runs at least some distance back along the rudder blade in the transition between the two rudder blade profiles 22,24. The water that is affected by the propeller is thereby given a favourable flow path back along the rudder blade 10.

Mounting of the Rudder Blade

Figure 4:
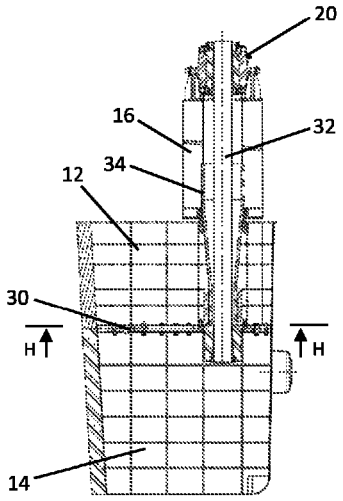
FIG. 4 shows a section of the rudder blade, the rudder stock and the steering gear.
Figure 5:
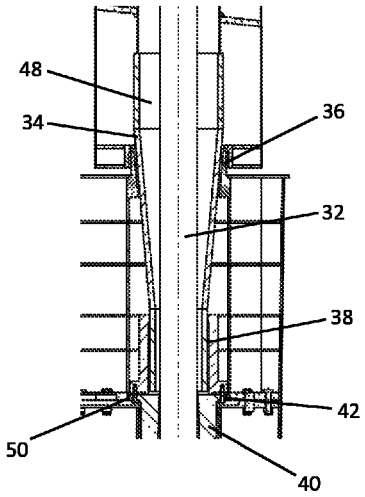
FIG. 5 shows a section of the fastening of the rudder stock to the rudder blade.
Figure 6:
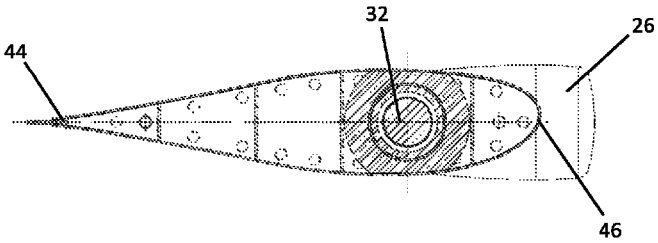
FIG. 6 shows a section of the rudder blade through the line G-G in FIG. 2.
Figure 7:
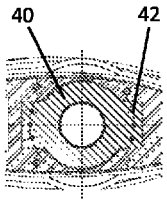
FIG. 7 shows a section of a fastening detail in the rudder blade in the line H-H in FIG. 4.
Figure 8:
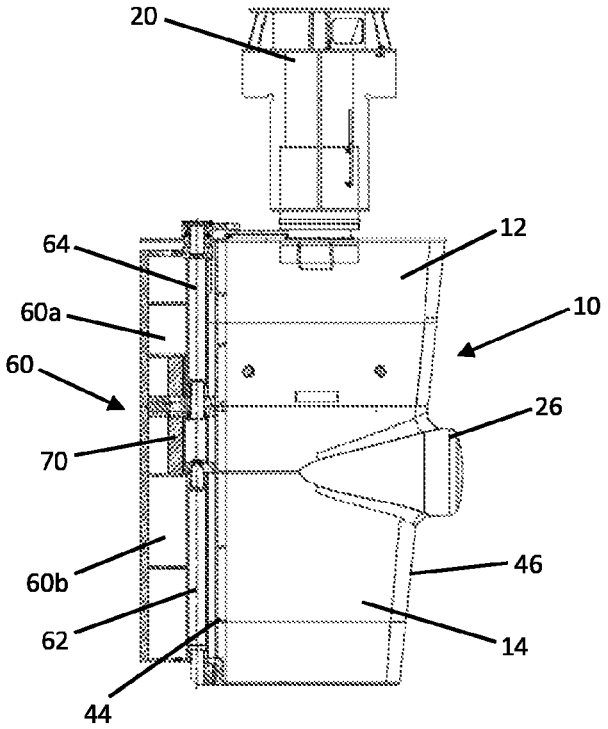
FIGS. 8 and 9 show a rotor blade with divided flaps.

FIGS. 4 and 5 in particular show in more detail the fastening of the rudder blade 10. As can be seen the rudder stock 32 runs from a steering gear 20 or rudder machine and is fastened to the same, where the steering gear is placed in the aft end 16 of the ship and into the rudder blade 10. At least parts of the rudder stock 32 are surrounded by an external tube 34, where the tube 34 extends through the whole, or parts of, the upper rudder blade part 12. The tube 34 is formed with an inner bore 48 and the tube can be formed in a lower area in a circular-cylindrical shape that goes over into an above-lying conical shape. The outer tube 34 is preferably fastened in the upper rudder blade part 12 and the aft end 16 of the ship, respectively, where the tube 34 can again go over into a circular-cylindrical form. The rudder stock 32 extends through the outer tube 34 and down into the lower rudder blade part 14. The function of the outer tube 34 is, among other things, to transfer bending forces and shear forces from the rudder blade 10 to the hull, i.e. the aft end 16 of the ship.

A couple of bearings, preferably in the form of two radial bearings 36,38 are arranged about the outer tube 34. These bearings will significantly help to reduce the friction. The lower bearing 38 is placed in a known way about a lower part of the tube 34 and in the upper rudder blade part 12. On the other hand, the upper bearing 36 is not fastened to the upper rudder blade part 12 and is thus not placed in an overlapping area between the rudder blade and the rudder box, but is more specifically mounted securely to the hull 16 at the aft end of the ship. The upper bearing 36 can be securely bolted to the hull above the rudder blade, or be fastened in another way. This placing of the upper bearing leads to the forces from the rudder being transferred directly to the hull of the ship, and which thus reduces the forces that influence the upper rudder blade part 12 in particular.

This placing of the upper bearing 36 distributes the bending moment from the rudder forces to the hull 16 distributed onto a larger area and thus gives a smaller load on the hull structure. This placing also gives an increased distance between the upper and lower bearings, which reduces the radial forces further.

As mentioned the rudder stock 32 extends down into the lower rudder blade part 14 and the end of the rudder stock 32 is fastened here in the lower rudder blade part 14. According to the invention this can be arranged in that the end of the rudder stock 32 is fastened to a coupling part, which can preferably be in the form of a sleeve coupling 40 that surrounds the end of the rudder stock 32.

The sleeve coupling 40 can be fastened to the end of the rudder stock 32 with the help of a bolt connection, wedge coupling, shrink fitting, or other fastening methods. Furthermore, the sleeve coupling 40 can be formed with an upper flange 50 for fastening to a corresponding section on the lower part of the upper rudder blade part 12, alternatively on the upper part of the lower rudder blade part 14, for example, with the help of bolts 42. The aim of the sleeve coupling 40 is, among other things, to transfer the torque moment and weight from the rudder blade 10 to the rudder stock 32, while the rudder stock 32 contributes to the transfer of the torque moment and weight from the steering gear 20 to the sleeve coupling 40.

The rudder stock 32 can be formed with a circular-cylindrical form, either as a solid or a hollow shaft. With the use of a hollow shaft a considerable weight reduction can be achieved with respect to known solutions, but also as a solid shaft as many rudder stocks are formed with a reinforced middle section, which can be avoided with the use of said radial bearings.

In an alternative, if not preferred, embodiment of the fastening of the rudder stock, the rudder stock can be equipped with a lower flange connection which is, for example, securely bolted to the lower rudder blade part 14.

Rudder Blade with Flaps

The present invention also relates to a rudder blade 10 as described and with flaps. The flaps can be in one piece or, as shown in the figures, in several parts.

Figure 9:
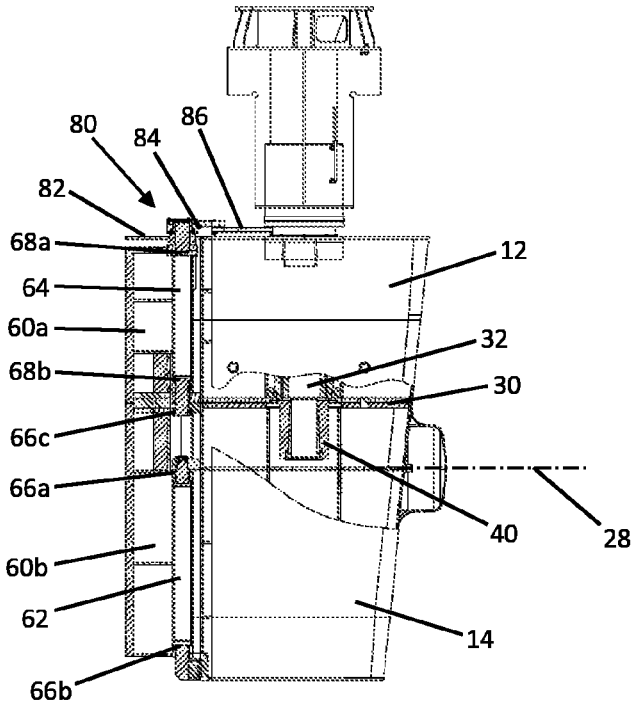

As FIGS. 9 and 10 show the rudder blade 10 comprises rear flaps 60 which are horizontally fixed to the rear edge 44 of the rudder blade. With horizontal is meant as shown in the figures. If the rear edge of the rudder blade should be tilted, the flaps will naturally also be able to be mounted correspondingly tilted.

The flaps 60 can run with the same symmetrical form as the rudder blade 10. Furthermore, the flaps 60 is divided as shown into an upper and a lower part 60*a*, 60*b* that move together, but as an alternative, can also move independently of each other. The latter shall be explained in more detail later.

Regardless of which rudder blade type is used, the upper and lower part 60*a*, 60*b* of the flaps 60 will normally be arranged in respective upper and lower hinges 68*a*, 68*b*; 66*a*, 66*b*. The upper hinge 68*a* of the upper part 60*a* of the flaps 60 is placed in an upper part of the rudder blade 10 and the lower hinge 68*b* to the upper part 60*a* of the flaps 60 is placed in an area above the central axis 28 which corresponds with the shaft of the propeller. The upper hinge 66*a* of the lower part 60*b* of the flaps 60 is placed adjoining, or in, the central axis 28 which corresponds with the shaft of the propeller and the lower hinge 66*b* of the lower part 60*b* of the flaps 60 is placed in a lower part of the rudder blade 10.

In the case of a solid rudder blade it will also be possible to place the lower hinge 68*b* of the upper parts 60*a* of the flaps 60 in or adjoining the area for the central axis 28. Alternatively it will be possible to mount the upper part 60*a* and the lower part 60*b* of the flaps 60 in a common hinge placed centrally between the upper and the lower hinge 68*a*, 66*b*.

In the embodiment shown for a divided rudder blade the lower part 60*b* of the flaps 60 is rotary mounted in a lower hinge 66*b* in the lower rudder blade part 14 and in an upper hinge 66*a* in the lower rudder blade part 14. The upper hinge 66*a* is preferably placed in or adjoining the central axis 28 that corresponds with the shaft of the propeller. The upper part 60*a* of the flaps 60 is correspondingly rotary mounted in a lower hinge 68*b* in the upper rudder blade part 12 and in an upper hinge 68*a* in the upper rudder blade part 12. The lower hinge 68*b* is preferably placed in or adjoining an area where the two rudder blade parts 12,14 are connected.

Furthermore, the upper part 60*a* of the flaps 60 is rotary mounted on a fastening shaft 64 arranged between the lower hinge 68*b* and the upper hinge 68*a* in the upper rudder blade part 12. The fastening shaft 64 for the upper part 60*a* of the flaps 60 can also extend into a further hinge 66*c* placed in the upper part of the lower rudder blade part 14. Correspondingly, the lower part 60*b* of the flaps 60 is rotary mounted on a fastening shaft 62 arranged between the lower hinge 66*b* and the upper hinge 66*a* in the lower rudder blade part 14.

With the expression "hinge" is meant any form for mounting that makes it possible for the parts to revolve.

The flaps 60 extend in the same or a somewhat lower height than the rudder blade 10. In the embodiment shown the lower part 60*b* of the flaps 60 can extend from an area adjoining the lower hinge 66*b* in the lower rudder blade part 14 to an area adjoining the lower hinge 68*b* in the upper rudder blade part 12. The upper part 60*a* of the flaps 60 will then naturally cover the rest of the rudder blade 10 and extend from an area adjoining the lower hinge 68*b* to an area adjoining the upper hinge 68*a* in the upper rudder blade part 12.

For simultaneous rotation of the flaps 60 the upper part 60*a* and the lower part 60*b* of the flaps 60 can be connected via a coupling piece 70 for transmission of power between the parts 60*a*, 60*b* and where the coupling part 70 can be set up to function as a shear pin. The aim of the shear pin function is that the coupling piece 70 shall break before, for example, a steering device coupled to the flaps 60 breaks. The coupling piece 70 can be placed, as shown in the figures, adjoining the area where the two rudder blade parts 12,14 are connected.

On the upper rudder blade part 12 a steering device 80 can be mounted, for example, on a plate 82, which is coupled to the fastening shaft 64 of the upper part 60*a* of the flaps 60. The steering device 80 comprises an arm 84 coupled to a steering rod 86, where the steering rod 86 is connected with the steering gear 20. Thereby, the steering gear 20 of the rudder blade can steer the rotation of the flaps 60, either with the same angle as the rudder blade 10 or with another given angle. Because of the coupling piece 70 both the parts 60*a*, 60*b* of the flaps are rotated at the same time even if the parts 60*a*, *b* are mounted independently.

The steering device 80 can, in a further development of the invention (not shown), also be set up for individual rotation of the upper part 60*a* and the lower part 60*b* of the flaps 60. Individual rotation of the flaps parts 60*a*, 60*b* can be carried out, for example, in that the upper fastening shaft 64 is hollow and that the lower fastening shaft 62 extends through the upper fastening shaft and is connected to its own part of the steering device 80. Thus, the steering device 80 can comprise an extra arm coupled to an extra steering rod, where the additional steering rod is connected to the steering gear 20.

It is also possible that a hydraulic cylinder or actuator, for example, is mounted in the upper rudder blade part 12 and/or in the lower rudder blade part 14 and which via a respective stag connection is set up to simultaneous or individual rotation of the flaps parts 60*a*, 60*b*. Said hydraulic cylinder or actuator can be steered via the steering gear 20 or be set up to receive steering signals separately.

With the use of one piece flaps 60 the upper hinge 68*a* and the lower hinge 66*b* will naturally be used.

It shall be pointed out that the divided flaps described above will be able to function on any rudder blade of the suspension type. Correspondingly, this will also be the case for the solution for the coupling together of the two rudder blade parts above the central axis that corresponds with the shaft of the propeller. Furthermore, it is considered that the mounting solution described will be able to function for any rudder blade of the suspension type.

With regard to the forming of the steering gear, construction of the rudder blade with internal ribs etc., and also other naturally associated technical elements these are considered to be known to a person skilled in the arts and are therefore not described in any detail.

The invention claimed is:

1. Rudder arrangement on a ship, comprising a rudder blade which is fastened via a rudder stock to an aft end of the ship the rudder blade is a rudder blade of suspension type, comprising a first rudder blade part and a second rudder blade part, arranged above and below each other, respectively, the rudder stock is mounted in and fastened to the rudder blade and extends up into the aft end of the ship, where the rudder stock is coupled at an upper end to a steering gear arranged at the aft end of the ship; and an outer tube is arranged about the rudder stock, where the outer tube is fastened in the first, upper rudder blade part and the aft end of the ship, respectively, and that the rudder stock extends through the outer tube and down into the second, lower rudder blade part, and a lower radial bearing is arranged about the outer tube in the upper rudder blade part, and that an upper radial bearing is arranged about the outer tube and to the aft end of a hull wherein two rudder blade parts are coupled together in a bolt connection that lies in an area above a central axis which corresponds to a shaft of a propeller, wherein said central axis makes up a divide between two corresponding, twisted rudder blade profiles, and wherein the lower rudder blade part comprises a whole of the lower rudder blade profile and also parts of an upper rudder blade profile, and that an upper rudder blade part comprises a rest of the upper rudder blade profile.

2. Rudder arrangement according to claim 1, wherein a sleeve coupling is arranged in an upper part of the lower rudder blade part and that a lower part of the rudder stock is mounted in the sleeve coupling.

3. Rudder arrangement according to claim 2, wherein the sleeve coupling is connected to the upper rudder blade part.

4. Rudder arrangement according to claim 1, wherein the rudder blade is a twisted rudder blade of suspension type, comprising the first rudder blade part and the second rudder blade part arranged above and below each other, respectively, where said rudder blade parts further comprise a first rudder blade profile and a second rudder blade profile that are twisted in relation to each other.

5. Rudder arrangement according to claim 1, wherein two rudder blade profiles are formed to be correspondingly alike and are formed with an approximately parabolic-formed nose section which runs, on one side, in a gently arched shape towards and beyond, a largest profile thickness of the rudder blade and runs, on the other side, in a more pronounced arched shape towards and beyond, the largest profile thickness of the rudder blade, and that from an area where said arched shapes end the rudder blade profiles run symmetrically toward a rear edge of the rudder blade in a concave shape.

6. Rudder arrangement according to claim 1, wherein the rudder blade is equipped, at a rear end, with vertically arranged flaps.

7. Rudder arrangement according to claim 6, wherein the flaps comprises an upper and a lower part arranged above and below each other, respectively.

8. Rudder arrangement according to claim 7, wherein the upper and the lower parts of the flaps are placed in upper and lower hinges respectively, where the upper hinge of the upper part of the flaps is placed in an upper part of the rudder blade and the lower hinge to the upper part of the flaps is placed in an area above a central axis that corresponds to the shaft of the propeller, and the upper hinge of the lower part of the flaps is placed adjoining or in the central axis that corresponds with the shaft of the propeller, and the lower hinge of the lower part of the flaps is placed in a lower part of the rudder blade.

9. Rudder arrangement according to claim 7, wherein the lower part of the flaps is rotary mounted in a lower hinge in the lower rudder blade part and in an upper hinge in the lower rudder blade part, where the upper hinge is placed in or adjoining a central axis that corresponds with the shaft of the propeller.

10. Rudder arrangement according to claim 9, wherein the lower part of the flaps extends from an area adjoining the lower hinge in the lower rudder blade part to an area adjoining the lower hinge in the upper rudder blade part, and the upper part of the flaps extends from an area adjoining the lower hinge to an area adjoining the upper hinge in the upper rudder blade part.

11. Rudder arrangement according to claim 9, wherein the lower part of the flaps is rotary mounted on a fastening shaft placed between the lower hinge and the upper hinge in the lower rudder blade part.

12. Rudder arrangement according to claim 9, wherein the upper part of the flaps is rotary mounted on a fastening shaft placed between the lower hinge and the upper hinge in the upper rudder blade part.

13. Rudder arrangement according to claim 12, wherein the fastening shaft for the upper part of the flaps extends into a further hinge placed in an upper part of the lower rudder blade part.

14. Rudder arrangement according to claim 7, wherein the upper part of the flaps is rotary mounted in a lower hinge in the upper rudder blade part, where the lower hinge is placed adjoining an area where the two rudder blade parts are connected, and in an upper hinge in the upper rudder blade part.

15. Rudder arrangement according to claim 7, wherein the upper part and the lower part of the flaps are connected via a coupling piece where the coupling piece is set up to function as a shear pin.

16. Rudder arrangement according to claim 6, wherein the rudder blade comprises a steering device connected to a fastening shaft of an upper part of the flaps and/or to a fastening shaft of a lower part of the flaps, where the steering device comprises at least one arm connected to a steering rod and where the steering rod is connected to the steering gear and that the steering device is arranged for joint, or individual, rotation of the upper part and the lower part of the flaps.

* * * * *